United States Patent [19]

Jones

[11] Patent Number: 4,717,005

[45] Date of Patent: Jan. 5, 1988

[54] COIN OPERATED WATERCRAFT WINCHES/CAPSTANS

[76] Inventor: Frederick L. Jones, 1777 SE. 15th St., Fort Lauderdale, Fla. 33316

[21] Appl. No.: 882,469

[22] Filed: Jul. 7, 1986

[51] Int. Cl.[4] ..... G07F 7/00; G07F 17/00; B66D 1/06

[52] U.S. Cl. ..... 194/208; 194/241; 254/362; 280/414.2

[58] Field of Search ..... 194/208, 209, 211, 241, 194/242, 900, 902; 254/266, 362; 280/414.1, 414.2

[56] References Cited

U.S. PATENT DOCUMENTS

| | | | |
|---|---|---|---|
| 2,637,525 | 5/1953 | Lock | 254/362 X |
| 2,691,448 | 10/1954 | Lontz | 194/902 X |
| 2,746,745 | 5/1956 | Damon | 194/211 X |
| 2,844,389 | 7/1958 | Burnett | 280/414.1 X |
| 2,991,046 | 7/1961 | Parsons | 254/266 |
| 3,242,894 | 3/1966 | Anderson | 254/266 X |
| 3,352,152 | 11/1967 | Abraham | 254/266 X |
| 3,474,922 | 10/1969 | Wood et al. | 254/362 X |
| 3,581,854 | 6/1971 | Versoy | 254/266 X |
| 3,944,039 | 3/1976 | Houghtaling | 194/208 |

*Primary Examiner*—F. J. Bartuska
*Attorney, Agent, or Firm*—Alvin S. Blum

[57] ABSTRACT

Capstans and winches secured to beach or boat launching ramp. Operate on electric power for predetermined time interval upon insertion of coin, token or card for common use by the general public. Assist in launching and especially hauling out of watercraft and watercraft carriers. Also reduces potential for personal injury and property damage from loss of traction on slippery slopes.

24 Claims, 8 Drawing Figures

FIG. 6
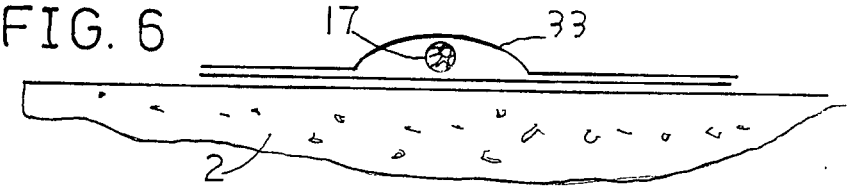
FIG. 5
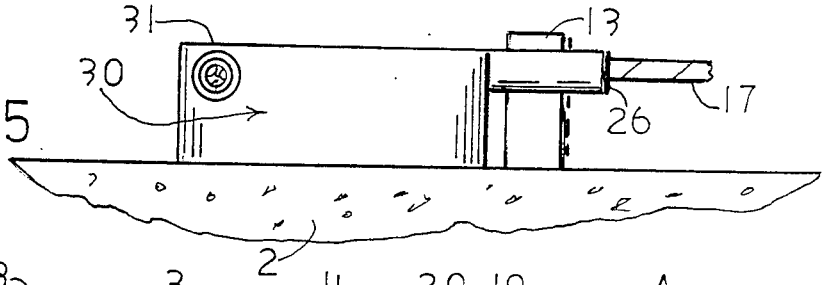
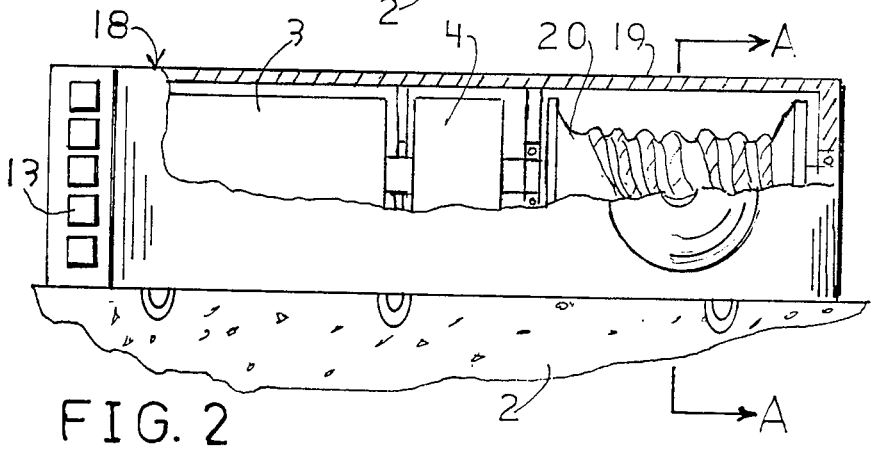
FIG. 2

COIN OPERATED WATERCRAFT WINCHES/CAPSTANS

This invention relates to capstans and winches and more particularly to capstan and winch systems for launching and hauling watercraft out of the water that operate for a fixed time upon insertion of a card, a coin, or a token so that they can be used by the general public.

BACKGROUND OF THE INVENTION

Various watercraft are commonly launched and hauled out at beaches and launch ramps by recreational boaters. At beaches, oversize tires or rollers facilitate these processes on the loose sand, but pulling the craft out of the water up the usual incline can be difficult since a land vehicle is unavailable for assistance because of poor traction in the sand.

At paved launching ramps, one generally has the boat on a trailer attached to a land vehicle (truck or automobile). Launching is generally easier than hauling out. One launches by backing down the inclined slope until the boat will float when it is rolled off the trailer. For hauling out, one backs down until the rear portion of the trailer is immersed and the bow can float onto the trailer rollers. Then the boat must be winched upward onto the trailer. Alternatively, with "float on" trailers, the trailer is backed down underneath the floating boat and boat and trailer are hauled out together by the vehicle.

Boat hauling out, therefor, requires backing the vehcle very close to the water' edge. After the boat is seated on the trailer, the entire load must be pulled up the incline. The incline surface often provides poor traction, being wet, covered with algae, sand, mud, and the like. Releasing the brake and simultaneously accelerating from a dead stop up a slippery slope without rolling backwards taxes the skills of the driver. After a boating excursion, the driver may be suffering the effects of fatigue, alcohol, and anxiety from pressures of others awaiting use of overcrowed public facilities. The effort may also overtax the power of the vehicle, causing it to stall and roll backwards. Consequently, many vehicles have rolled into the water with great financial loss. Seeing a vehicle rolling into the water prompts onlookers to misguided attempts to stop it, often resulting in personal injury. Some try to push or improve traction by climbing onto vehicle or trailer with resulting injury. Furthermore, overtired, overheated boaters may overexert in these stressful circumstances causing heat strokes or cardiovascular accidents.

SUMMARY OF THE INVENTION

It is an object of the invention to provide an electrically powered pulling device, permanently installed at a launching station to render powered assistance in the launching and especially the hauling out of watercraft to multiple users by the payment of a token fee for a predetermined time interval of use. It is a further object to provide that assistance that overcomes traction problems by securely affixing said pulling device to the surface of said launching station. It is a further object to provide pulling assistance to reduce risk to personnel and property. It is a further object to provide a timed interval of pulling by said device operably by coin, token or card. It is a further object to provide said pulling means including a rotary drum for pulling a line attachable to watercraft, watercraft trailer or vehicle. It is a further object to provide control means for operating said pulling device in a plurality of operating modes including; brake; pull; reverse; release with friction for permitting pulling out said line without overrunning of said drum. The control is designed to default to brake mode when control is lost. A remote control such as an infra-red transmission system may be provided. Accessory apparatus may be included to render operation more fool-proof including overload protection devices, stop mechanism when line is fully wound onto drum, covers to keep out dust, dirt, fingers, vandals, level wind mechanism to wind line smoothly onto drum. Optionally the pulling device may be secured at a site away from the ramp with the line passing through a pulley in line with the ramp.

These and other objects, features and advantages of the present invention will become more apparent from the following description taken in connection with the accompanying drawings, wherein:

FIG. 2 is a horizontal winch of the invention in front elevation with a portion of the outer cover broken away.

FIG. 5 is a side elevation of a horizontal pulley portion of the invention with control assembly.

FIG. 6 is a cross sectional view of the cable inside a protective surface duct.

Figure 1:
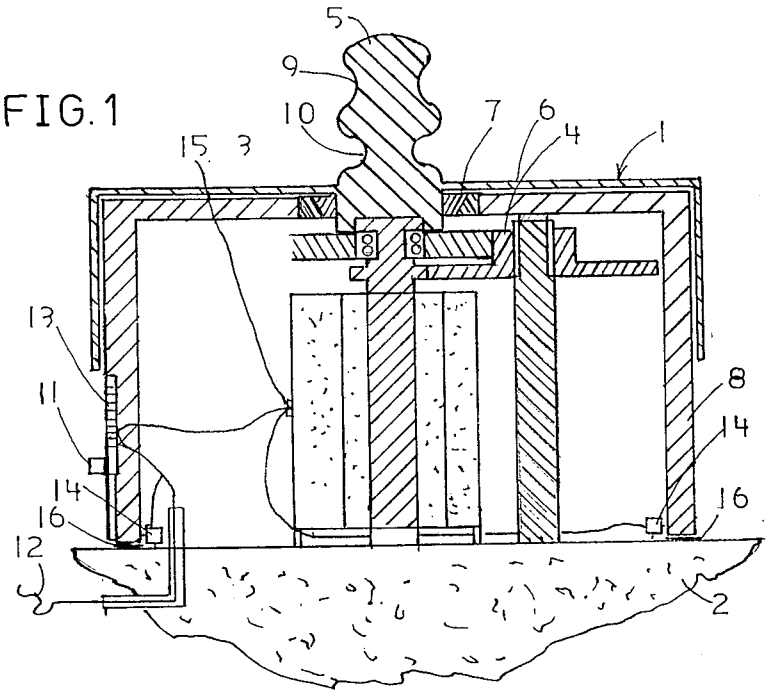
FIG. 1 is a front elevation, in cross section of a vertical capstan of the invention.

FIG. 1 shows a vertical capstan of the invention. This is firmly secured to the surface of the ramp or beach, such as by embedding its base in a large concrete block 2 whose upper surface may be flush with the ramp surface. The capstan is driven by electric motor 3 which drives reduction gear assembly 4 which rotates drum assembly 5 and attached covering skirt 6 at a low speed in sturdy bearign 7 supported by bearing support 8 that transfers pulling forces to the concrete 2. The drum assembly 5 is shown with two drums, 9 of large diameter for lower power and higher speed and 10 of smaller diameter for higher power and lower speed. Buried electric power lines 12 power the electric motor 3. Token receiver mechanism 11 on control assembly 13 controls power to the motor. Insertion of the appropriate token energizes the motor for a predetermined time interval. A rope connected to whatever is to be pulled up the beach incline or ramp is wound several times around either drum 9 or drum 10 and tension is applied to the free end to control traction on the drum to regulate pulling in a manner well known in the art. The token may be a coin or a frangible token and the token receiver may be such as the Tokette chute by Greenwald Industries, Brooklyn, N.Y. that breaks the token on acceptance. This is especially useful at remote locations to discourage looting by vandals. The tokens could be sold by boating-related retailers. Alternatively, the control device may be actuated by a card carrying special indicia such as magnetic codes. Manual controls on control assembly 13 may select various modes of operation including stop, reverse, forward, brake. Alternatively, a remote control may be operable such as the infra-red remote controls used to operate home appliances. The drum surface may be smooth for pulling rope or ridged for pulling chain. The motor, speed reducer capstan drum and bearings may take the form of the many variations well known in the art. The skirt 6 is designed to cover the working parts and protect them from sand, dust and vandals. A current overload switch 15 may be connected in the electrical circuit to stop the motor when an excessive load is applied. Alternatively, slip clutches (not shown) or overload switches 14 connected between the concrete base 2 and the support 8 may be used to cut off power when excessive loads are applied. Resilient connectors 16 provide slight movement of support 8 under heavy load.

Figure 3:
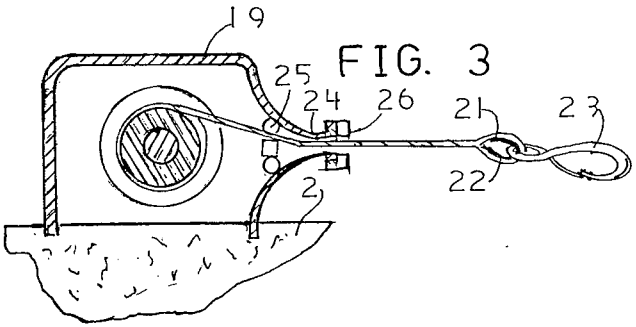
FIG. 3 is a cross sectional view of FIG. 2, taken on line A—A.

Refer now to FIG. 2 showing, in front elevation, a horizontal winch 18 of the type carrying an attached stainless steel cable 17. FIG. 3 is a cross section through A—A of FIG. 2. Cover 19 encloses all moving parts. It is partially broken away in FIG. 2 to show electric motor 3, reduction gear assembly 4 and horizontally rotating spool assembly 20 with stainless steel cable 17 wound thereon. A first end of cable 17 is attached to spool 20 and a second end forms a loop 21 swaged about thimble 22. The loop holds hook 23. The winch 18 is secured to the surface of beach or ramp such as by anchoring to a large concrete block 2. Hook 23 engages the watercraft, the trailer on which the watercraft rests, or the vehicle attached to the trailer/watercraft. The control assembly 13 controls the operation of the winch as described above. A motor operated reverse for unwinding cable 17 off spool 20 is not recommended because this might cause tangles on the spool. Instead, an operating mode is provided that permits the spool to rotate in reverse direction (unwinds cable) when the cable is pulled out by hook 23. The mode includes enough frictional resistance to rotation of spool 20 to prevent free-spooling and subsequent backlash entanglement of cable on spool. The cover 19 includes a tapering nozzle 24 including guide rollers 25 to provide smooth movement to and from the spool. A spring loaded collar 26 electrically connected to motor 3 cuts off power when swaged loop 21 is drawn up to it. This exemplifies means well known in the art of winches to prevent damage and permit smooth operation. Included in this category are slip clutches, overload relays, level winding mechanisms and the like. It is to be noted that in order to meet the object of providing a hauling device usable by many untrained individuals, devices and accessories must ensure safe and effective operation with minimal skill.

Figure 4:
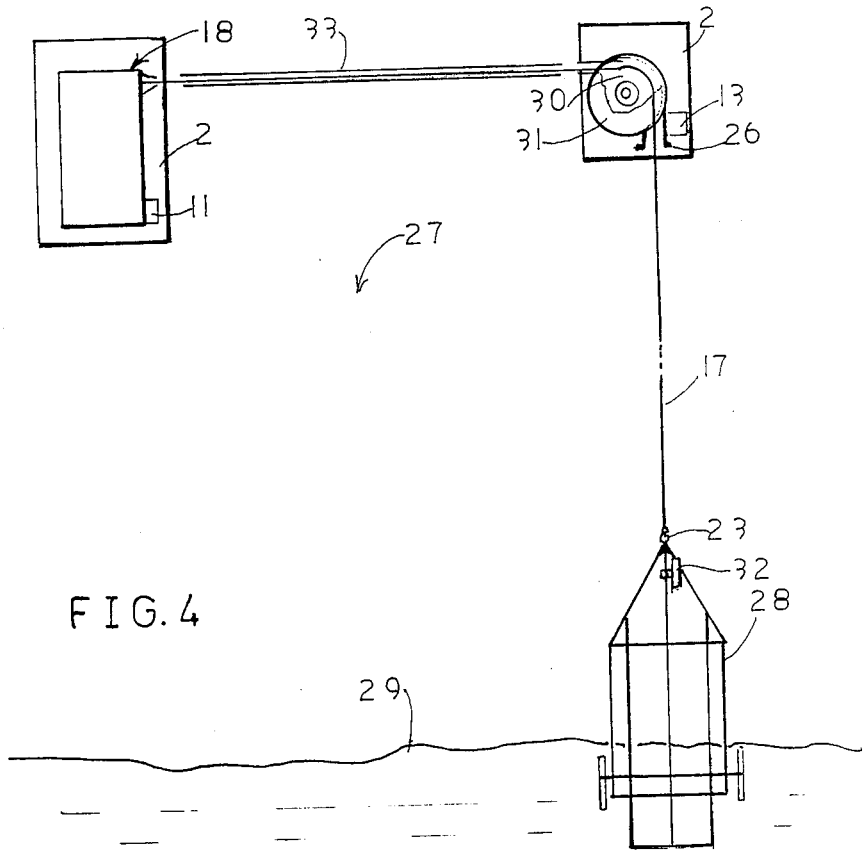
FIG. 4 is a diagrammatic plan view of the invention in use with a horizontal pulley.

FIG. 4 shows schematically a winch 18 of the invention in use on an inclined ramp 27 at waterway 29. A boat trailer (size reduced) is connected to cable 17 by hook 23. After a boat (not shown) is drawn up on trailer 28 such as by "floating on", the winch 18 actuated by inserting a token in token receiver mechanism 11, pulling cable 17 that passes around horizontal pulley 30 whose cover 31 has been partially broken away. The trailer 28 is shown with a nose wheel 23 such as is commonly found on the jack used for disconnecting the trailer from the vehicle. The winch is placed to one side and the pulley used in those situations where it may be undersirable to have the winch itself in the middle of the ramp. The pulley 30 is shown in side elevation in FIG. 5. Control assembly 13 and loop power cut off mechanism 26 may be installed at the pulley. Close fitting cover 31 prevents cable 17 from falling off the horizontal pulley. A covered raceway 33 applied to the surface of ramp 27 may protect cable 17 therein during its passage between winch 18 and pulley 30, as shown in FIG. 6.

Figure 7:
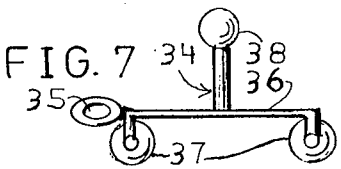
FIG. 7 is a front elevation of a dolly for supporting the front end of the trailer while using the invention.

The rope or cable may be hooked to a boat, a boat trailer, or a vehicle with trailer attached. A wheeled dolly 34 as shown in FIG. 7 may also be useful for attaching hook 23 to loop 35 on platform 36, having wheels 37 and also supporting hitch ball 38. The trailer is unhitched from the vehicle and hitched to ball 38 for use in hauling out and launching using the invention without a vehicle.

Figure 8:
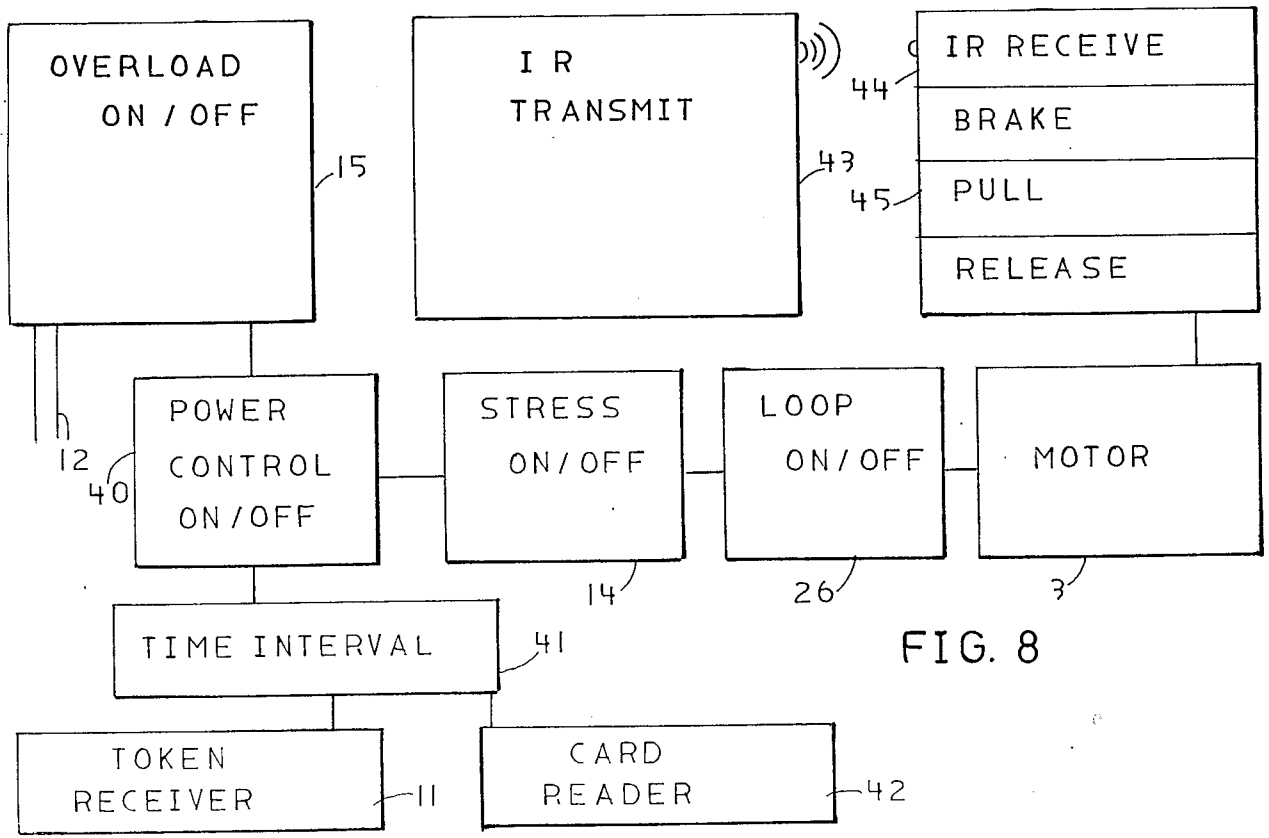
FIG. 8 is a diagrammatic representation of the control circuitry.

FIG. 8 illustrates diagrammatically the control circuitry of the invention. Electric motor 3 receives power from electric power line 12. Safety cut off devices connected series with the power line include current overload switch 15, mechanical stress switch 14, limit switch 26 that actuates when cable terminating loop 21 is drawn up to the winch. The actuation of either token receiver 11 or card reader 42 initiates a time interval in interval timer 41 that turns on power switch 40 and then turns it off at the end of the time interval preset in interval timer 41. Control of various modes of operation are operated by manual controls 45. Alternative control of modes of operation is by remote infra-red transmitter 43 transmitting control commands to infra-red receiver 44.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. An electrically powered winch system for improved launching and hauling out of watercraft for installation at a site where land meets water including beaches, boat ramps and the like, comprising:

a. electric motor means;

b. speed reduction means having an input connected to said motor means and an output driven by said input that provides a lower rotational speed and higher torque than said motor means;

c. cable spool means rotatable about a horizontal axis, said spool means connected to, and driven, by said output of said reduction means;

d. spool support means journalled to rotatably support said spool means in bearing means, said support means including means for permanent installation at the surface of said land to resist pulling forces generated in said hauling out;

e. electric supply means connected to said electric motor means for supplying electric power to drive said motor means;

f. electric control means connected between said electric supply means and said motor means to control the flow of electric current to said motor means;

g. time interval means operationally connected to said control means to cause said control means to make available a flow of electric current to said motor means continuously throughout a predetermined time interval when actuated by an outside signal; and h. token receiving means connected to said time interval means to provide said outside signal upon receipt of a specific token.

2. The invention of claim 1, including a cable with two ends, a first end fastened to said spool means and a second end with attaching means for attaching to watercraft, watercraft trailer, land vehicle and the like to provide pulling forces devoid of the usual traction problems associated with hauling watercraft up an incline at the water's edge.

3. The invention of claim 1, including overload protection means connected to said electric control means to cut off said electric current when excessive load is applied.

4. The invention of claim 1, including slip clutch means interposed between said electric motor means and said spool means to prevent overloading said motor means when excessive load is applied.

5. The invention of claim 2 including:

winch enclosing means covering said spool means to restrict access thereto, said enclosing means including an aperture through which said cable passes; and end of cable sensing means connected to said aperture and to said control means to cut off the flow of electric current when said second end of said cable reaches said aperture.

6. The invention of claim 1, said token receiving means including:

means to break said token after receipt; and said specific token being of a frangible nature.

7. The invention of claim 1, said token being a coin.

8. The invention of claim 1, including card reading means connected to said time interval means to provide said outside signal upon insertion of a specific card having specific machine readable indicia.

9. The invention of claim 1, including manual operation control means operationally connected to said spool means and said control means to provide a plurality of operational modes, including spool braking, spool reversing, spool releasing with friction and the like, to permit the usual operations involved in pulling out said cable while connecting to watercraft low on an incline, pulling up said incline and stopping when desired.

10. The invention of claim 9, including remote operational control means connected to said spool means and said control means to provide a plurality of operational modes, including spool braking, spool reversing, spool releasing with friction and the like to permit the usual operations involved in pulling out said cable while connecting to watercraft low on an incline, pulling up said incline and stopping when desired.

11. The invention of claim 2 including:

horizontal pulley means;

pulley covering means closely covering said pulley, said covering means having two apertures;

pulley supporting means journalled to rotatably support said pulley means, said pulley support means including means for permanent installation at the surface of said land to resist pulling forces generated in said hauling out;

said cable passing in a first said aperture, around a portion of said pulley means and out a second said aperture, said pulley covering means preventing said cable from falling from said pulley means, wherein said pulley means changes the direction of pull of said winch.

12. The invention of claim 2 including wheeled dolly means having two connectors, a first connector for reversible attachment to said second end of said cable and a second connector for reversible attachment to said watercraft trailer, said dolly supported by a plurality of wheels.

13. An electrically powered capstan system for improved launching and hauling out of watercraft for installation at a site where land meets water including beaches, boat ramps and the like, comprising:

a. electric motor means;

b. speed reduction means having an input connected to said motor means and an output driven by said input that provides a lower rotational speed and higher torque than said motor means;

c. line drum means rotatable about a vertical axis, said drum means connected to, and driven, by said output of said reduction means;

d. drum support means journalled to rotatably support said drum means in bearing means, said support means including means for permanent installation at the surface of said land to resist pulling forces generated in said hauling out;

e. electric supply means connected to said electric motor means for supplying electric power to drive said motor means;

f. electric control means connected between said electric supply means and said motor means to control the flow of electric current to said motor means;

g. time interval means operationally connected to said control means to cause said control means to make available a flow of electric current to said motor means continuously throughout a predetermined time interval when actuated by an outside signal; and h. token receiving means connected to said time interval means to provide said outside signal upon receipt of a specific token.

14. The invention of claim 13, including overload protection means connected to said electric control means to cut off said electric current when execessive load is applied.

15. The invention of claim 13, including slip clutch means interposed between said electric motor means and said drum means to prevent overloading said motor means when excessive load is applied.

16. The invention of claim 13, said token receiving means including:

means to break said token after receipt; and said specific token being of a frangible nature.

17. The invention of claim 13, said token being a coin.

18. The invention of claim 13, including card reading means connected to said time interval means to provide said outside signal upon insertion of a specific card having specific machine readable indicia.

19. The invention of claim 13, including manual operation control means operationally connected to said drum means and said control means to provide a plurality of operational modes, including drum braking, drum reversing, drum releasing with friction and the like, to permit the usual operations involved in pulling out said line while connecting to watercraft low on an incline, pulling up said incline and stopping when desired.

20. The invention of claim 19, including remote operational control means connected to said drum means and said control means to provide a plurality of operational modes, including drum braking, drum reversing, drum releasing with friction and the like to permit the usual operations involved in pulling out said line while connecting to watercraft low on an incline, pulling up said incline and stopping when desired.

21. The invention of claim 13, said drum means including a plurality of line engaging drums of different diameters to provide a choice of speeds and torque.

22. The invention of claim 13, said drum means having a surface suitable for engaging a chain.

23. An electrically powered winch system for improved launching and hauling out of watercraft for installation at a site where land meets water including beaches, boat ramps and the like, comprising:

a. electric motor means having high torque and low speed properties;

b. cable spool means rotatable about a horizontal axis, said spool means connected to, and driven, by said motor means;

c. spool support means journalled to rotatably support said spool means in bearing means, said support means including means for permanent installation at the surface of said land to resist pulling forces generated in said hauling out;

d. electric supply means connected to said electric motor means for supplying electric power to drive said motor means;

e. electric control means connected between said electric supply means and said motor means to control the flow of electric current to said motor means;

f. time interval means operationally connected to said control means to cause said control means to make available a flow of electric current to said motor means continuously throughout a predetermined time interval when actuated by an outside signal; and g. token receiving means connected to said time interval means to provide said outside signal upon receipt of a specific token.

24. An electrically powered capstan system for improved launching and hauling out of watercraft for installation at a site where land meets water including beaches, boat ramps and the like, comprising:

a. electric motor means having high torque and low speed properties;

b. line drum means rotatable about a vertical axis, said drum means connected to, and driven, by said motor means;

c. drum support means journalled to rotatably support said drum means in bearing means, said support means including means for permanent installation at the surface of said land to resist pulling forces generated in said hauling out;

d. electric supply means connected to said electric motor means for supplying electric power to drive said motor means;

e. electric control means connected between said electric supply means and said motor means to control the flow of electric current to said motor means;

f. time interval means operationally connected to said control means to cause said control means to make available a flow of electric current to said motor means continuously throughout a predetermined time interval when actuated by an outside signal; and g. token receiving means connected to said time interval means to provide said outside signal upon receipt of a specific token.

* * * * *